United States Patent [19]

Brouthers

[11] 4,058,050

[45] Nov. 15, 1977

[54] GUN LEVELING DEVICE

[75] Inventor: Paul E. Brouthers, Monson, Mass.

[73] Assignee: Dan Wesson Arms, Inc., Monson, Mass.

[21] Appl. No.: 706,606

[22] Filed: July 19, 1976

[51] Int. Cl.[2] ..... F41C 21/18

[52] U.S. Cl. ..... 89/14 C

[58] Field of Search ..... 89/14 C, 14 D

[56] References Cited

U.S. PATENT DOCUMENTS

| | | | |
|---|---|---|---|
| 812,140 | 2/1906 | Kent | 89/14 C |
| 858,745 | 7/1907 | McClean | 89/14 C |
| 1,315,504 | 9/1919 | Humm | 89/14 C |
| 1,401,667 | 12/1921 | Brown | 89/14 C |
| 2,916,970 | 12/1959 | Mutter | 89/14 C |
| 3,858,481 | 1/1975 | Elliott | 89/14 C |

FOREIGN PATENT DOCUMENTS

| | | | |
|---|---|---|---|
| 737,125 | 12/1932 | France | 89/14 D |
| 332,849 | 9/1958 | Switzerland | 89/14 C |
| 100,408 | of 1918 | United Kingdom | 89/14 D |

*Primary Examiner*—Stephen C. Bentley
*Attorney, Agent, or Firm*—Wolf, Greenfield & Sacks

[57] ABSTRACT

A barrel and shroud construction for reducing recoil and jumping of the firearm. Gases are tapped from the rifled barrel through a plurality of radially arranged passages in the barrel into a circumferential expansion chamber defined between the barrel and shroud. The gases are vented from the circumferential expansion chamber via a pair of venting orifices disposed rearwardly of the radially arranged passages.

11 Claims, 3 Drawing Figures

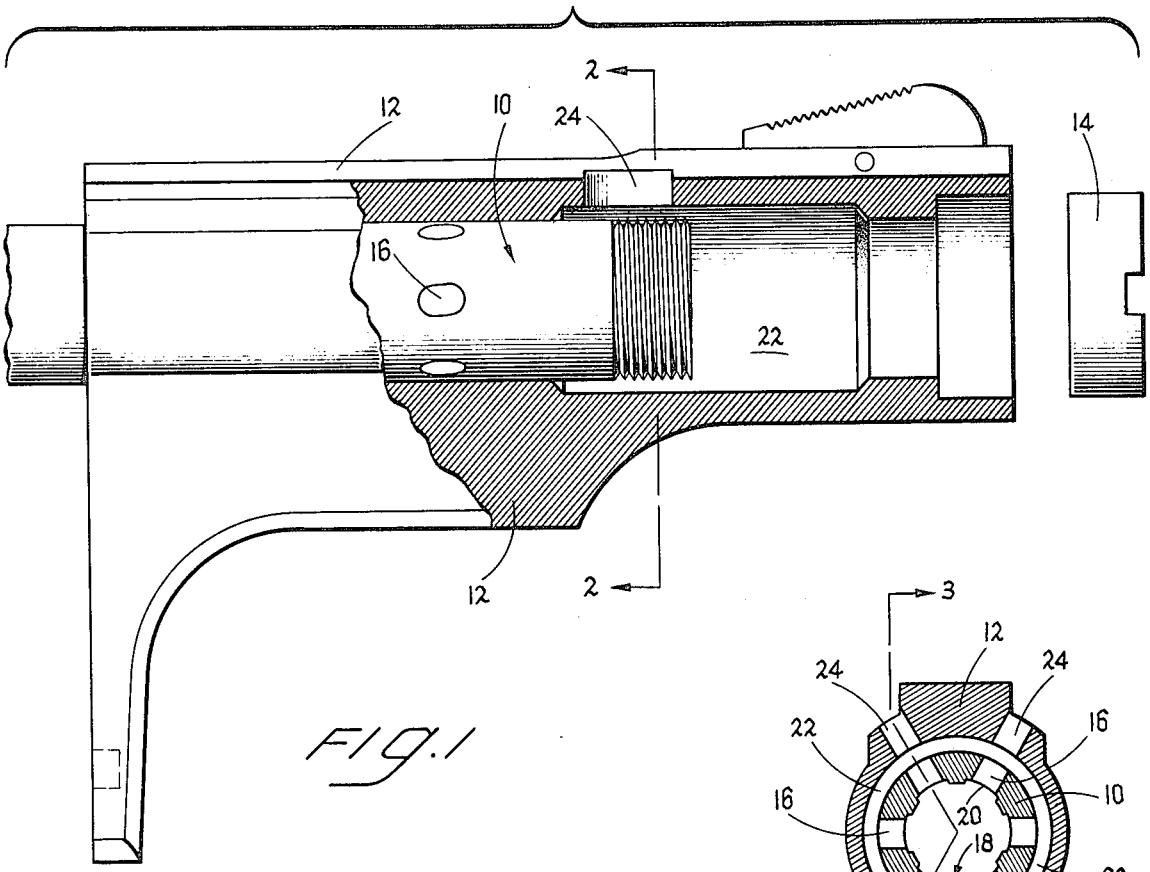
FIG. 1
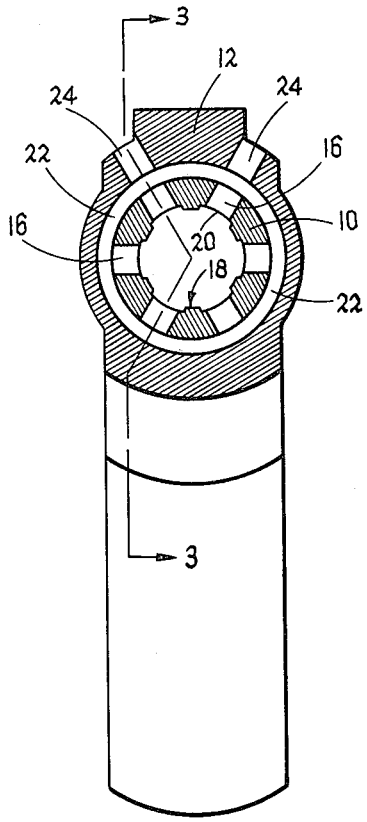
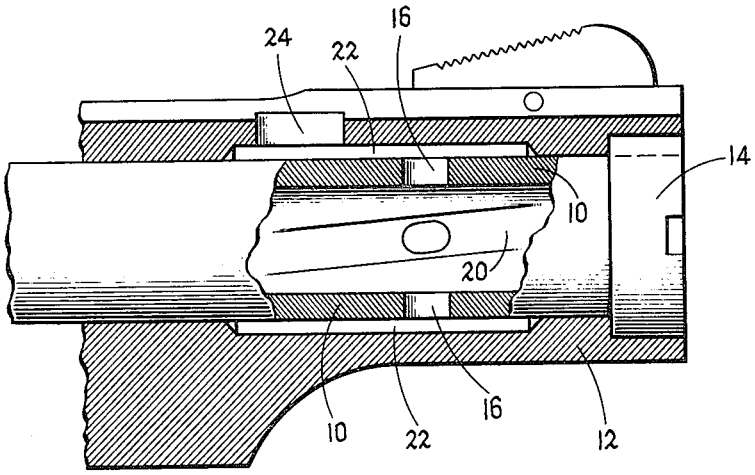
FIG. 3
FIG. 2

GUN LEVELING DEVICE

BACKGROUND OF THE INVENTION

The present invention relates to an improvement in the construction of a gun barrel so as to reduce recoil and jumping of the firearm. More particularly, this invention pertains to an improvement in the gas control near the muzzle of a firearm to improve recovery from recoil of the firearm thereby allowing for the more rapid aiming and successive firing of a weapon.

The prior art shows different gun leveling constructions. See for example U.S. Pat. No. 3,808,943. In this particular patent venting is provided directly to the atmosphere thereby causing an unbalance in the gas column which in turn creates decelerating effect on the projectile. The prior art also teaches use of an adapter or an attachment to the muzzle of a firearm. The problem with this adapter is that it may inherently cause misalignment of the firearm and affect the accuracy of the firearm.

Accordingly, one object of the present invention is to provide an improved barrel construction which substantially reduces firearm recoil and jumping and also substantially impedes the discharge of hot gases and flames from the firearm.

Another object of the present invention is to provide a gun leveling construction which comprises an expansion chamber preferably formed between the barrel and surrounding shroud.

A further object of the present invention is to provide a technique of tapping gas uniformly around the circumference of a rifled barrel from the grooves in the rifling to a lower pressure expansion chamber and from there through orifices in the shroud to the atmosphere.

Still another object of the present invention is to provide a gun leveling construction which reduces the velocity of the gases escaping from the barrel and prolongs the escape time to the atmosphere. In this way the hot gases and flames exiting from the firearm are reduced thereby reducing the effect therefrom on the operator and those nearby.

Another object of the present invention is to provide a plurality of radially disposed barrel passages for the gases which terminate in the internal grooves of the rifled barrel. In this way no deformation of the projectile by the interrupted bearing surfaces of the rifling is accomplished.

Still a further object of the present invention is to provide a gun leveling construction which also significantly reduces muzzle flare of the hot gases by burning a large portion of the gases in the expansion chamber before exhausting these gases to the atmosphere.

Another object of the present invention is to provide a gun leveling construction wherein the gases tend to circulate in the expansion chamber. This phenomenon occurs primarily because the passages in the barrel and the exiting orifices are disposed at opposite ends of the expansion chamber.

SUMMARY OF THE INVENTION

To accomplish the foregoing and other objects of this invention there is provided an apparatus for controlling muzzle jump or recoil of a firearm. The firearm typically comprises a barrel with a uniform diameter bore and a shroud which also has a bore or passage for snugly receiving the barrel. In accordance with the invention a plurality of radially directed passages are formed in the barrel extending through the wall of the barrel. In the disclosed embodiment six passages are formed. A circumferential channel is formed in the bore of the shroud and defines an expansion chamber between the barrel and the channel in the shroud. This expansion chamber is positioned along the barrel so as to communicate with the plurality of radially directed passages in the barrel. At least one orifice is defined in the shroud extending from the channel for providing communication of gases from the chamber to the atmosphere. It is preferred that the radially directed passages be disposed at a front end of the expansion chamber while the orifice or orifices are disposed at a rear end of the expansion chamber. In this way the escaping gases can be circulated in the expansion chamber before exiting from the orifice. This construction also provides a reduction of any flame that may tend to occur upon a firing of the firearm. This is especially important when the firearm is used, for example, by police, in the night time.

BRIEF DESCRIPTION OF THE DRAWINGS

Numerous other objects, features and advantages of the invention should now become apparent upon a reading of the following detailed description taken in conjunction with the accompanying drawings, in which:

FIG. 1 is a cross-sectional view through the barrel of a firearm showing one embodiment of the present invention with the barrel being inserted into the shroud;

FIG. 2 is a cross-sectional view taken along line 2—2 of FIG. 1; and

FIG. 3 is a cross-sectional view taken along line 3—3 of FIG. 2.

DETAILED DESCRIPTION

The drawings show cross-sections through the barrel 10 of a firearm which may be a rifle or a handgun. FIGS. 1 and 3 show the muzzle end of the barrel 10. In a hand gun the barrel 10 is secured at its opposite end to the body of the firearm. In the disclosed embodiment a shroud 12 fits over the barrel and the muzzle end of the barrel is threaded to receive a lock nut 14 for maintaining the shroud in a fixed position about the barrel. In accordance with the invention the barrel is provided with a plurality of radially directed passages 16 extending through the wall of the barrel. The passages 16 are shown in FIG. 2 as numbering six. The bore of the barrel 10 has a rifled surface 18 defining rifling grooves 20. The passages 16 terminate at the surface of the grooves 20 so as to provide no interference with the rifling surface 18 so that proper projectile action occurs. The shroud 12 is provided with a circumferential channel 22 which also extends somewhat lengthwise of the shroud as indicated in FIG. 2. This channel 22 defines an expansion chamber that communicates by way of ports 16 with the barrel bore.

In the preferred embodiment the communication of gas to the atmosphere is provided by way of two orifices 24 which are radially disposed in the shroud at an angle therebetween of about 60°. It is noted that the passages 16 are disposed at the forward end of the expansion chamber while the orifices 24 are disposed at the rear end of the chamber. The structure has found to be of advantage in gradually venting the gases from the firearm. Furthermore, the gases and flames are circulated in the expansion chamber for exiting through the orifices 24 and thus flaming from the firearm is prevented. It has also been found that with the improvement of this invention there is a more linear recoil thus reducing the amount of flip or jump on the weapon which is especially advantageous for combat or sports use.

Having described one embodiment of the present invention it should now become apparent to those skilled in the art that numerous other embodiments exist all of which are contemplated as falling within the scope of this invention. For example, the disclosed embodiment shows a shroud but one could also practice the invention with a special two-part barrel construction defining a circumferential expansion chamber with barrel passages and output orifices.

What is claimed is:

1. Apparatus for controlling muzzle jump or recoil of a pistol or revolver having a barrel with grooves forming a rifled bore and a shroud with a bore and fitting about the barrel comprising;

means forming a plurality of radially directed passages extending through the wall of the barrel, said passages terminating at their inner ends in openings on the inner surface of said barrel, said openings extending parallel to the direction of said grooves, means forming a channel only in the bore of the shroud to form an expansion chamber between the barrel and shroud and positioned to communicate with the plurality of radially directed passages, and means defining at least one orifice in the upper portion of the shroud extending from the channel to communicate from the chamber to the atmosphere means for reversing the gas flow in the expansion chamber including said passages disposed at and communicating with a front end of the expansion chamber and said at least one orifice disposed at and communicating with the rear end of the expansion chamber, the maximum longitudinal distance between said passages and said orifice being greater than the circumferential distance between said orifice and an adjacent passage.

2. Apparatus as set forth in claim 1 including a pair of orifices both at the upper portion of the shroud with at least one of said orifices being in substantial alignment in a direction along the barrel with one of the passages.

3. Apparatus as set forth in claim 1 wherein the cross-sectional area of the expansion chamber is greater than the cross-sectional area of the bore in the barrel.

4. Apparatus as set forth in claim 1 wherein the passages are equally spaced about the circumference of the barrel.

5. Apparatus as set forth in claim 4 wherein the passages are disposed about a plane that is orthogonal to the axis of the barrel.

6. Apparatus as set forth in claim 1 wherein there are two orifices in the shroud.

7. Apparatus as set forth in claim 1 including nut means engageable with the end of the barrel and compressing against the shroud.

8. Apparatus as set forth in claim 1 wherein said openings are spiraled following the grooves.

9. Apparatus as set forth in claim 1 including two orifices arranged to be in alignment in a longitudinal direction with two of the passages.

10. Apparatus as set forth in claim 1 including six passages each having a substantially eliptical cross-section with a width on the order of or less than the width of a rifling groove, said channel being defined only in the shroud, and said orifices arranged to be in alignment in a longitudinal direction respectively with two of the passages.

11. Apparatus as set forth in claim 1 wherein the orifices are only at the rear end of the chamber.

* * * * *